US007120962B2

(12) United States Patent
Petner

(10) Patent No.: US 7,120,962 B2
(45) Date of Patent: Oct. 17, 2006

(54) CLEANING IMPLEMENT HEAD WITH DUAL CLEANING MEMBERS

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 11/069,149

(22) Filed: Mar. 1, 2005

(65) Prior Publication Data

US 2006/0195996 A1 Sep. 7, 2006

(51) Int. Cl.
*A47L 13/12* (2006.01)

(52) U.S. Cl. ..... 15/118; 15/144.1; 15/228; 15/244.2

(58) Field of Classification Search ..... 15/105, 15/106, 114, 115, 118, 147.2, 220.1, 228, 15/231, 232, 144.1, 244.2
See application file for complete search history.

(56) References Cited

U.S. PATENT DOCUMENTS 1,084,184 A * 1/1914 Wenieke ..... 15/220.1
1,989,921 A * 2/1935 Goddard ..... 15/118
2,304,127 A * 12/1942 Stetson ..... 15/231
2,943,339 A * 7/1960 Vosbikian et al. ..... 15/118
4,407,213 A * 10/1983 Evans ..... 114/222
5,095,574 A * 3/1992 Khanzadian ..... 15/118
6,052,858 A * 4/2000 Drakulic ..... 15/244.2
6,216,307 B1 * 4/2001 Kaleta et al. ..... 15/119.2

* cited by examiner

*Primary Examiner*—Mark Spisich
(74) *Attorney, Agent, or Firm*—Stuart M. Goldstein

(57) ABSTRACT

A cleaning tool implement has a cleaning head having dual parallel aligned supports. The supports can take the form of interconnected parallel plates which are configured and sized to receive and removeably secure cleaning elements, for example, bonnets with stranded mop, scrub pad, brush, cloth and sponge surfaces, which can be adapted for removable attachment to the plates. The handle of the cleaning tool is connected to the cleaning head via a universal swivel joint which permits the head to rotate 360° in relation to the handle. This rotational movement permits the cleaning tool to be used on an infinite number of vertical, horizontal, angled, raised, and low surfaces.

7 Claims, 2 Drawing Sheets

CLEANING IMPLEMENT HEAD WITH DUAL CLEANING MEMBERS

BACKGROUND OF THE INVENTION

There are many handled cleaning tools which employ a variety of cleaning heads for various cleaning functions. The cleaning head on most common cleaning implements comprises a handle connected to a single cleaning element, e.g. a strand mop element, scrubber component, spongemop head, etc. These cleaning implements offer satisfactory cleaning, but since they each only have one cleaning element, their versatility is limited. As a result, the use to which the implement is put is restricted to the sole function of the cleaning elements and so the implement itself has limited application.

SUMMARY OF THE INVENTION

It is thus the object of the present invention to provide a cleaning implement which overcomes the limitations and disadvantages of prior cleaning implements.

It is an object of the present invention to the provide a cleaning implement which allows the use of two different cleaning elements, thus providing versatility for the implement.

It is a further object of the present invention to provide a cleaning implement with two cleaning elements which can be easily removed and cleaned or replaced with other similar or different elements.

It is still another object of the present invention to provide a cleaning implement which can be used on horizontal, vertical, angled, raised, or low surfaces where varied cleaning elements would be of assistance.

It is another object of the present invention to provide a cleaning implement which comprises a cleaning head with dual cleaning element support members configured to receive and removeably maintain a variety of cleaning elements.

These and other objects are accomplished by the present invention, a cleaning implement with a cleaning head having dual parallel aligned supports. The supports can take the form of interconnected parallel plates which are configured and sized to receive and removeably secure cleaning elements, for example, bonnets with stranded mop, scrub pad, brush, cloth and sponge surfaces, which can be adapted for removable attachment to the plates. The handle of the cleaning tool is connected to the cleaning head via a universal swivel joint which permits the head to rotate 360° in relation to the handle. This rotational movement permits the cleaning tool to be used on an infinite number of vertical, horizontal, angled, raised, and low surfaces.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Cleaning implement 1 comprises handle 2 connected to mop head 3 by universal swivel joint 4. Joint 4 permits 360° rotational movement of cleaning head 3 in relation to handle 2. Such a universal swivel joint is known in the art and is commonly used for cleaning not only horizontal, but vertical and angled surfaces.

Handle 2 can be a unitary member or it can be telescoping in nature to permit its length to be longitudinally adjustable for various uses, including for cleaning high or wide surfaces. Such handles are often used in combination with automobile brush type cleaners, where extension of a handle is helpful in reaching surfaces where access may be difficult.

Figure 1:
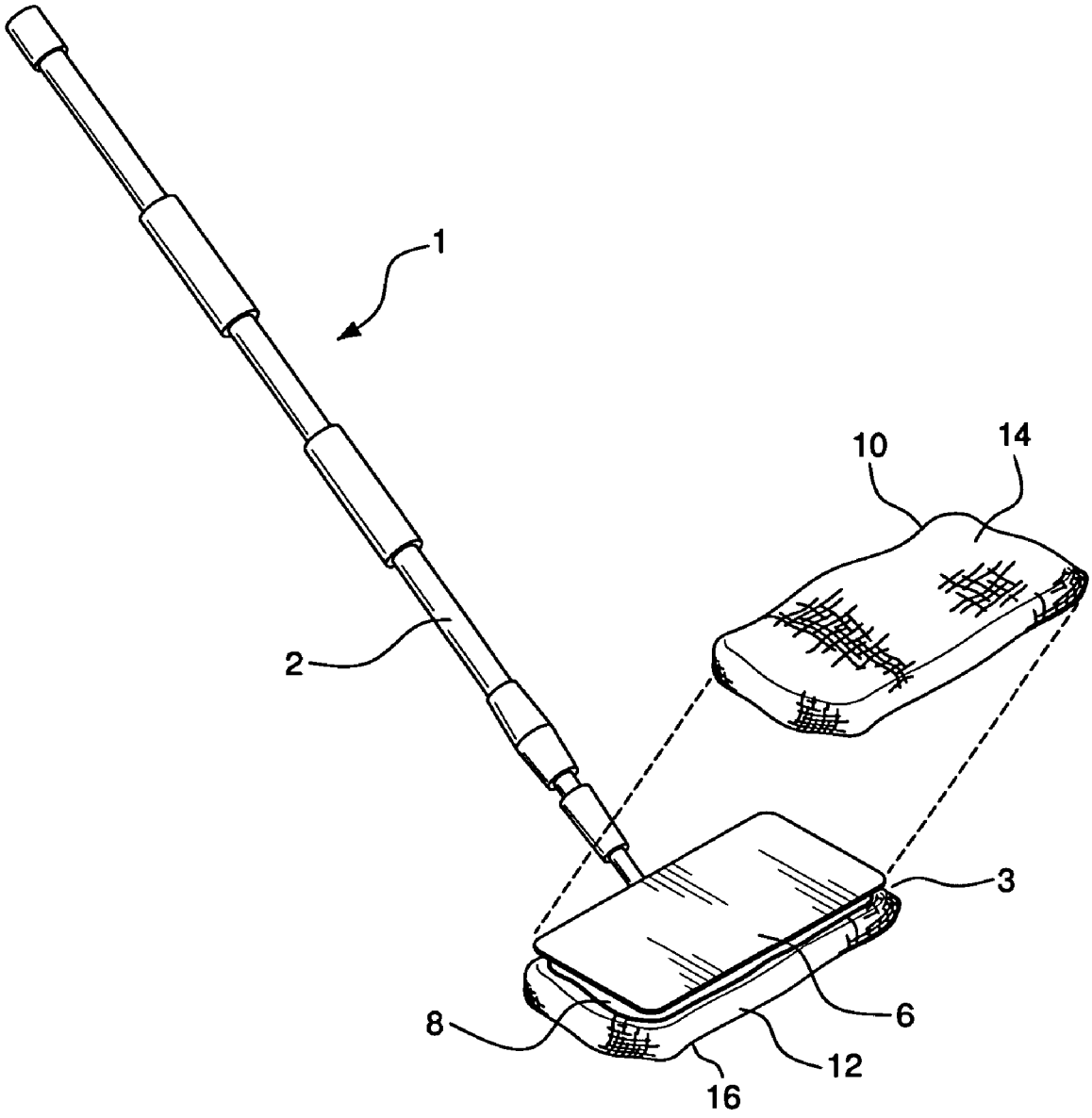
FIG. 1 is an isometric view of the cleaning tool of the present invention, showing the manner of attachment of the cleaning elements contemplated to be used.
Figure 2:
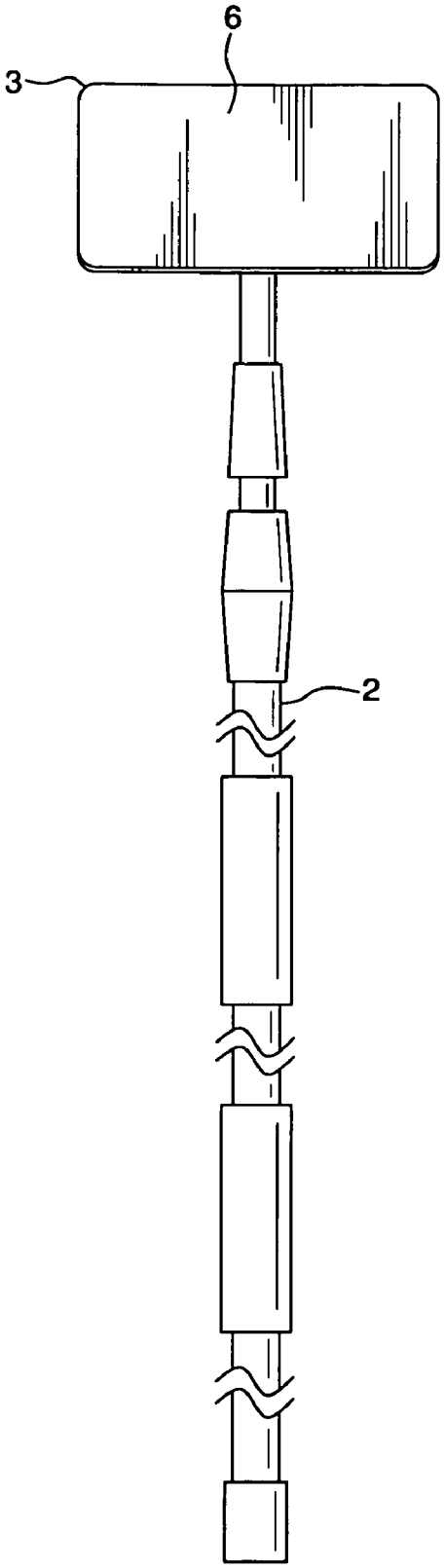
FIG. 2 is a top view of the cleaning implement of the present invention.
Figure 3:
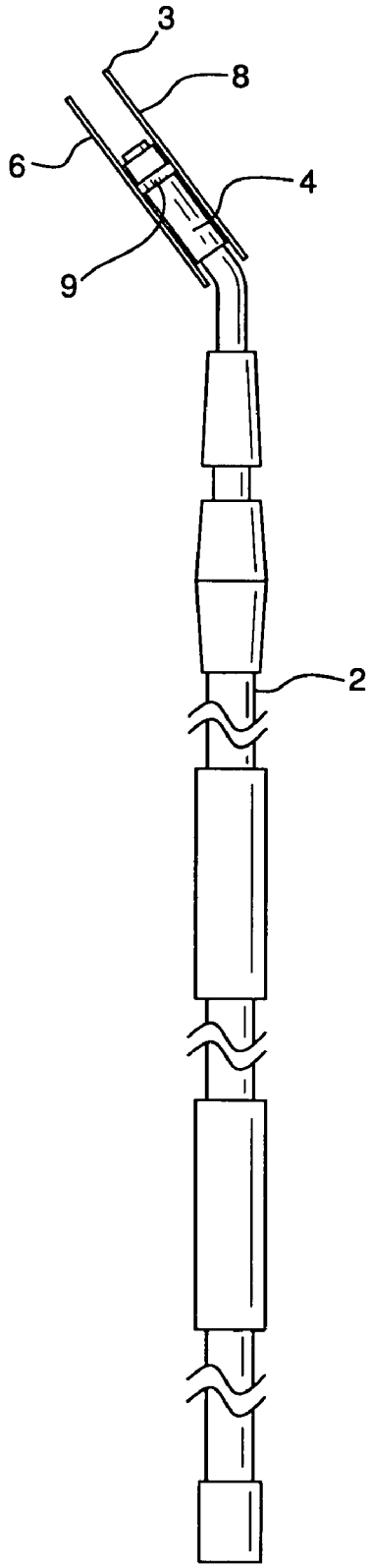
FIG. 3 is an elevation view of the cleaning implement of the present invention.

Cleaning head 3 comprises dual supports shown in FIGS. 1–3 as being parallel aligned plate members 6 and 8, interconnected such as by intermediate support 9. Plate members 6 and 8 are configured to receive separate cleaning elements 10 and 12 respectively. Although not so restricted, cleaning elements 10 and 12 can take the form of cleaning bonnets consisting of a central pad of sponge or foam-like substance. Each element has cleaning surfaces 14 and 16, which can comprise a scrub pad, strand mop, brush, cloth, sponge, or similar scrubbing or wiping cleaning surface. It is further contemplated that each cleaning element would be configured to fit over plate members 6 and 8 and be maintained thereon. One such configuration calls for cleaning elements 10 and 12 to be secured on to their respective plate members by expandable elastic bands on the cleaning elements which substantially surround the plate members to hold the elements in place. Cleaning elements 10 and 12 are unique in that they are reversible in nature, providing two cleaning surfaces on element. Such cleaning elements are specifically the subject of applicant's co-pending U.S. application Ser. No. 11/069,150, entitled Reversible Cleaning Bonnet, the disclosure of which is incorporated by reference herein.

While specific unique cleaning elements are discussed herein, the subject invention also contemplates attachment of cleaning elements to plate support members 6 and 8 by means of alternate attachment vehicles such as Velcro®, snaps, spring clips, bonnet clips or equivalent connection means. The subject invention is not deemed to be restricted to the manner of attaching the cleaning elements and support members.

In use, cleaning elements 10 and 12 are positioned over and maintained on support members 6 and 8. The cleaning elements can have two identical or two different cleaning surfaces. For instance, elements 10 and 12 could both have scrub surfaces or element 10 could have a scrub surface and element 12 could have a sponge or strand mop or other type of cleaning surface. In this manner, cleaning tool 1 has the versatility of using dual cleaning surfaces on the same tool and the ability to continually change cleaning surfaces based upon the needs of the user. When one or more of the cleaning elements 10 and 12 become soiled or unusable, they can easily be removed and either washed or discarded. Fresh cleaning elements can then be replaced onto support members 6 and 8.

The rotational capability of swivel 4 allows head 3 of cleaning implement 1 to be positioned in a variety of angled configurations for use on vertical, horizontal, and angled surfaces. The telescopic nature of handle 2 permits length adjustment of cleaning tool 1.

It is anticipated that cleaning implement 1 is an ideal tool for cleaning not only floors, but also for dusting surfaces, including higher surfaces. The dual cleaning surfaces of cleaning implement 1 especially makes the tool versatile for cleaning surfaces which may require several different cleaning modes, for instance scrubbing and wiping. Thus, cleaning implement 1 is especially valuable in cleaning vehicles, especially those which have higher or wider surfaces, like those on vans and trucks.

The uses described herein are not to be considered restrictive of the manner in which cleaning implement 1 is to be used, but just considered as exemplary for purposes of showing the versatility of the tool of the present invention.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A cleaning implement comprising:

implement head means for cleaning surfaces which are vertical, horizontal, and angled in relation to the head means and for cleaning surfaces which are higher than the head means, said head means comprising:

(a) first and second parallel aligned elongated plate members, each having a given length and an internal surface, said surfaces forming an open space between the plate members;

(b) joint means located between the plate members to rotatably move the head means for cleaning the vertical, horizontal, angled and higher surfaces, said joint means having a fixed axis of rotation located between and substantially parallel to the first and second plate members, said axis being oriented generally perpendicular to the lengths of the plate members;

(c) a first cleaning element with at least one cleaning surface removeably secured on the first plate member; and (d) a second cleaning element with at least one cleaning surface removeably secured on the second plate member; and handle means connected to the joint means for rotatably connecting the handle means to the head means to rotatably position the head means for cleaning the vertical, horizontal and angled surfaces and for cleaning surfaces which are higher than the head means, the handle means having an elongated longitudinal axis and a bend adjacent to the joint means such that the axis of the handle means is at an angle with respect to the axis of the joint means, whereby the handle means is configured to raise and lower the head means to alternately position the head means on the vertical, horizontal, angled, and higher cleaning surfaces.

2. The cleaning implement as in claim 1 wherein the first and second plate members are spaced parallel in relation to each other.

3. The cleaning implement as in claim 1 wherein at least one of the cleaning element elements is a cleaning bonnet with at least one cleaning surface.

4. The cleaning implement as in claim 1 wherein at least one of the cleaning surfaces is a scrubbing surface.

5. The cleaning implement as in claim 1 wherein at least one of the cleaning surfaces is a wiping surface.

6. The cleaning implement as in claim 1 wherein the first and second cleaning elements have different cleaning surfaces.

7. The cleaning implement as in claim 1 wherein the joint means permits 360° rotateable movement of the head means in relation to the handle means.

* * * * *